United States Patent [19]

Chang et al.

[11] Patent Number: 4,776,993

[45] Date of Patent: Oct. 11, 1988

[54] EXTRUSION METHOD FOR OBTAINING HIGH STRENGTH COMPOSITE PROPELLANTS

[75] Inventors: Marguerite S. Chang, Forest Heights; Richard K. Mackne, Oxon Hill; Anthony Mycka, Jr., Waldorf, all of Md.; Carl L. Myers, Jr., Alexandria, Va.

[73] Assignee: The United States of America as represented by the Secretary of the Navy, Washington, D.C.

[21] Appl. No.: 470,506

[22] Filed: May 14, 1974

[51] Int. Cl.[4] ..... C06G 21/00

[52] U.S. Cl. ..... 263/3.3; 149/19.4; 149/19.9; 149/76; 149/109.6

[58] Field of Search ..... 149/76, 109.6, 19.9, 149/19.4; 264/3 B, 3.3

[56] References Cited

U.S. PATENT DOCUMENTS 3,028,274 4/1962 Winer ..... 264/3 B

*Primary Examiner*—Stephen J. Lechert, Jr.

*Attorney, Agent, or Firm*—Kenneth E. Walden; Thomas McDonnell

[57] ABSTRACT

A method of manufacturing composite propellants which include compounding the propellant with an extended final mix cycle, partially curing the propellant mixture to a specified hardness, and extruding the propellant under certain conditions.

7 Claims, No Drawings

EXTRUSION METHOD FOR OBTAINING HIGH STRENGTH COMPOSITE PROPELLANTS

BACKGROUND OF THE INVENTION

The present invention relates generally to propellant manufacture and in particular to an extrusion process for manufacturing crosslinked composite propellants.

Composite propellants consist of suspensions of crystalline oxidizers and metallic fuel in a polymeric binder. Additional ingredients, e.g., plasticizers, curing agents, stabilizers, burning-rate additives, and catalysts are also included in composite propellant formulations. The binder possesses terminal groups which crosslink with the crosslinking agent. Such a binder has good resistance to deformation during long storage.

The traditional method of manufacturing crosslinked composite propellants is by casting. With the cast method, the propellant mixture is introduced into a mold or a rocket motor where the mixture is cured by mild heating. This method is a batch operation and has all the disadvantages of a batch operation. Also if the propellant is cured in a rocket motor, extensive preparations are required before the propellant is introduced. On the other hand, curing the propellant in a mold characteristically requires large expenditures for tooling. For example in practical manufacturing one cast propellant, 48 molds were required.

Further there is a problem with the cured propellant releasing from the mold without damaging the outer surface of the molded propellant. The amount of heat being applied to the propellant mixture is crucial. There must be enough heat to ensure a complete cure throughout the propellant mixture without any degradative overcure of the exterior portion of the grains. Thus it is necessary to avoid excessively high cure temperatures and to avoid holding the cure temperature for too long a period of time. Safety is another problem with the cast method. It is not possible as with extrusion to shape the propellant by remote control in an isolated place. These problems are particularly acute for large grain propellants, i.e., propellants with a diameter of 6 inches or greater.

Because of the disadvantages associated with the cast method, there is interest in finding an alternative for manufacturing crosslinked composite propellants. Some success has been achieved with extrusion, but only with small grains, plastisol composite propellants or utilizing high temperature extrusion. Attempts at extruding crosslinked composite propellants into large grains and/or with high solids propellant loading has been unsuccessful because the propellant became too viscous for extrusion, or the propellant experienced degradation in the extrusion press, or the extruded product would not retain its shape upon handling. The last problem is often referred to as slumping.

SUMMARY OF THE INVENTION

Accordingly, an object of this invention is to provide a process for manufacturing crosslinked composite propellants.

Another object of this invention is to provide an extrusion process for large grains with high solids loading crosslinked composite propellants.

Another object of this invention is to provide a process for preparing composite propellants without the need of solvents.

Yet another object is to provide a process for extruding crosslinked composite propellant for a large grain and a high solid loading without any slumping in the extruded product.

A further object of this invention is to provide a safe, quick, economical method to manufacture large grain, high solids loading crosslinked composite propellants.

These and other objects are achieved by a thorough and prolonged mix so that the dispersion of the solids and the crosslinking agent are as uniform as possible, by partially curing the mixture to a hardness where the propellant is still extrudable and the extruded product is able to withstand slumping and by coating the mandrel of the extruder with Teflon for the preparation of intricate center configurations of the propellant, such as the eight point star configuration, and extruding the product under controlled conditions.

BRIEF DESCRIPTION OF THE PREFERRED EMBODIMENTS

The manufacturing process of this invention entails mixing the ingredients together in a conventional way except that the final mix cycle of the compounding is at least one hour long as opposed to the usual 15 minutes. The mix is then transferred to a 100° F. oven to partially cure the propellant to a hardness of about 40 to about 70 Shore-A-units. Preferably this hardness is from 55 to 65 Shore-A-units.

When a particular propellant formulation is first made with a particular compounding method a temperature-time cure curve is developed in order to determine the best cure time. Thus only during the first run of a propellant formulation would there be a need for testing the hardness of the propellant. This can be easily done by using a Shore Durometer.

When the propellant reaches the correct hardness it is then introduced into a ram press extruder which may have an extrusion barrel up to 18 or even 21 inches in diameter at a temperature of about 80° to about 100° F. The extrusion press conditions are: a pressure from about 300 to about 6000 psi, and a die temperature from about 90° to about 120° F. The rate of extrusion depends on the hardness of the precured propellant.

After extrusion the propellants are cured from about 130° F. to about 180° F. for about 24 to about 36 hours. The preferred cure is 160° F. to 180° F. for 24 hours. If the internal grain configuration is complicated, e.g., an eight point star, the extruder mandrel should be coated with Teflon* in order to improve the flow of the propellant through the extruder barrel.

*Teflon is a polytetrafluoroethylene polymer available from E. I. du-Pont

The process of this invention is suitable for any crosslinked composite propellant which is capable of being precurred to about 40 to about 70 Shore-A-units. The polymeric binder may be any polymer with a reactive terminal group, e.g., hydroxy terminated polybutadiene, polyglycols, diethylene glycol adipate, polyvinyl chloride, a copolymer of vinyl chloride and vinyl acetate, and the like. Preferably the binder is a 1,4 hydroxy terminated polybutadiene with a molecular weight of at least about 2500 and a hydroxyl number of at least 0.65 mg KOH/gm of sample. The most preferred hydroxyl number is 0.71 mg KOH/gm of sample. In formulating a propellant, the amount to be used is the amount necessary to give the requisite pre-extrusion hardness. This depends on the materials selected and solids loading. For the preferred polymeric binder, an amount from about 5 to about 15 weight percent is to used, with a preferred amount from 7 to 10 weight percent.

The crosslinking ingredient is a compound capable of reacting with the reactive end groups of the polymeric binder to form bonds between the two ingredients. The particular choice depends on the reactive groups of the polymeric binder. For reacting with the preferred binder, isocyanate compounds including aliphatic aromatic and cyclic types may be used. Any isocyanate which gives a strong final product can be used in the practice of the present invention. When reacted with the hydroxyl groups of the preferred polymeric binder, the isocyanate groups form ureathene linkages. The preferred isocyanate compound is 2,4 toluene diisocyanate. As with the polymeric binder, the amount of the crosslinking ingredient needed to provide the required pre-extrusion hardness depends on the materials selected and the solids loading. If the preferred polymeric binder and crosslinker are used, a NCO:OH ratio of about 0.90:1 to about 1:1 should be maintained. Preferably the NCO:OH ratio is from 0.95:1 to 1:1.

Suitable oxidizers include inorganic oxidizing salts such as ammonium, alkali metal, and alkaline earth metal salts of nitric, perchloric and chloric acids. The preferred oxidizer is ammonium perchlorate having a particle size from about 11μ to about 200μ. A mixture of coarse and fine ammonium perchlorate is used to improve stability. The amount of oxidizer is from about 75 to about 85 weight percent.

Other ingredients which may be added include a bonding agent, such as 1,3-dihydroxy ethyl 5,5-dimethyl hydantoin (DHE) or a 1/1 mole ratio mixture of trismethylaziridinyl phosphorus oxide (MAPO) and lactic acid which was mixed for one hour at 60° C. (MT-4L), a stabilizer such as aluminum, a ballistic modifier, such as ferric oxide, and an anti-oxidant such as phenyl β-naphthylamine (PBNA).

The test example given hereinafter in order to exemplify the invention and advantages thereof was prepared by the following method. It is only one method of many within the scope of the present invention. This specific method is given by way of example and is not meant to limit the present invention.

The 1,4 hydroxyl terminated polybutadiene (HTBP), phenyl β-naphthylamine (PBNA), aluminum, ferric oxide, and the bonding agent were introduced into a 150 gallon Perkins Mixer. The ingredients were heated to 160° F. and the mixer was evacuated to a vacuum of 15 mm Hg. The elevated temperature and vacuum were maintained during the following 30 minutes of mixing in order to degas the polymer. After the vacuum was removed and the temperature was lowered to 120° F., one half of the ammonium perchlorate was added and the mix without the vacuum was resumed for 10 minutes. Next the remaining ammonium perchlorate was added and the mix was continued for another 10 minutes. Before the final mix cycle was started, toluene diisocyanate was added.

After mixing the propellant for 60 minutes, the propellant was placed in a feeder pan which in this case was a flat pan. The pan was placed in an oven set at a temperature of 100° F. until the crosslinking mechanism gave the propellant a hardness from 55 to 65 Shore-A-unit. The hardness was checked periodically with a Shore Durometer. When the propellant became sufficiently hard, it was extruded at 110° F. at a rate of 20 ins/min in a 15 inch hydraulic ram extruder.

Upon exiting the extruder, the propellant was cut to length and completely cured in an oven at 170° F. for 24 hours.

The propellant composition prepared by the preceding method and tested for mechanical strength is given in the following table.

TABLE 1

| Ingredient | weight percent |
|---|---|
| 1,4 hydroxy terminated polybutadiene | 12.10 |
| phenyl β naphthylamine | 0.15 |
| MT-4L* | 0.20 |
| 2,4 toluene diisocyanate | 1.05 |
| ammonium perchlorate (200μ) | 43.00 |
| ammonium perchlorate (12μ) | 43.00 |
| ferric oxide | 0.10 |
| aluminum | 0.40 |

*MT-4L condensation product of lactic acid and trismethylaziridinyl phosphorus oxide The test results are summarized in Table II.

TABLE II

| | Tensile test @ strain Rate of 0.74 ins/in/min | | |
|---|---|---|---|
| Temp. | Max Stress (psi) | Max Elongation (%) | Young's Modulus (psi) |
| −65° F. | 952 | 5.1 | 29,064 |
| +77° F. | 251 | 26.0 | 2,116 |
| +165° F. | 172 | 16.9 | 1,604 |

As can be seen from the preceding example, the manufacturing method of the present invention provides a high quality, relatively inexpensive, safe and quick method of manufacturing crosslinked composite propellant having a large grain and a solid loading greater than 86 weight percent.

Obviously many modifications and variations of the present invention are possible in light of the above teachings. It is therefore to be understood that, within the scope of the appended claims, the invention may be practiced otherwise than as specifically described.

What is claimed as new and desired to be secured by Letters Patent of the United States is:

1. A method of preparing large diameter composite propellant grains by extrusion, wherein the improvement comprises utilizing a final mix cycle of at least about one hour, precuring the mixed propellant to a hardness from about 40 to about 70 Shore-A-units, extruding the precured propellant at a temperature of less than 120° F., and curing the extruded propellant.

2. The method of claim 1 wherein the final mix cycles is from 60 to 120 min.

3. The method of claim 1 wherein the mixed propellant is precured to a hardness from 55 to 65 Shore-A-units.

4. The method of claim 1 wherein the extruded propellant grain has a diameter of up to 21 inches.

5. A method of preparing large diameter composite propellant grains which comprises mixing a crosslinkable polymeric binder, an anti-oxidant, a metal fuel, a ballistic modifier and a bonding agent; heating the mixture; degassing the mixture; adding an oxidizer and a crosslinking agent to the mixture; subjecting the mixture to a final mix cycle of at least about one hour; precuring the mixed propellant to a hardness from about 55 to about 65 Shore-A units; extruding the precured propellant at a temperature of less than 120° F.; and curing the extruded propellant.

6. The method of claim 4 wherein the crosslinkable polymeric binder is hydroxy-terminated polybutadiene, the anti-oxidant is phenyl β-naphthylamine, the metal fuel is aluminum, the ballistic modifier is ferric oxide, the oxidizer is ammonium perchlorate and the crosslinking agent is toluene diisocyanate.

7. The method of claim 5 wherein the extruded propellant grain has a diameter of 15 inches.

* * * * *